US005697615A

United States Patent [19]

Gilbert

[11] Patent Number: 5,697,615

[45] Date of Patent: Dec. 16, 1997

[54] WORD LINKING GAME

[76] Inventor: Paul Gilbert, 9 Greers Road, Christchurch, New Zealand

[21] Appl. No.: 668,515

[22] Filed: Jun. 28, 1996

[30] Foreign Application Priority Data

Jun. 29, 1995 [NZ] New Zealand ..... 272467

[51] Int. Cl.[6] ..... A63F 1/00

[52] U.S. Cl. ..... 273/299

[58] Field of Search ..... 273/292, 299, 273/242, 243, 272, 429, 430, 431, 432

[56] References Cited

U.S. PATENT DOCUMENTS

| | | | |
|---|---|---|---|
| 1,542,819 | 6/1925 | Bloom | 273/299 |
| 3,053,537 | 9/1962 | Moss | 273/299 X |
| 4,306,725 | 12/1981 | Sawyer | 273/299 X |
| 5,271,623 | 12/1993 | Torres | 273/272 X |
| 5,282,631 | 2/1994 | Baker | 273/272 |
| 5,615,886 | 4/1997 | Chalfin et al. | 273/299 X |

*Primary Examiner*—William E. Stoll

*Attorney, Agent, or Firm*—Finnegan, Henderson, Farabow, Garrett & Dunner, L.L.P.

[57] ABSTRACT

A method and apparatus for playing a game is described. Players select a defined number of consonant and vowel cards. Each player selects, in turn, a question card where the question card incorporates a letter which forms part of the answer to the question and a score. The player whose turn it is attempts to answer the question using his or her cards by laying the completed word out on a playing surface, whereupon if the player successfully answers the question, he or she receives the number of points shown on the question card. Alternatively, the score allocated corresponds to the number of cards used. Variations on the game include having blocked cards which may not be used as the originating point for new words unless there are two or less words on the table. The winning player is the one who accumulates a fixed winning score or the one who gets that largest score at the time that all consonant and vowel cards are exhausted.

8 Claims, 2 Drawing Sheets

| | | | | | | | | |
|---|---|---|---|---|---|---|---|---|
| B | W | L | S | J | R | A | E | O |

Fig 1

An Animal/Bird with more than 3 letters including a

F

5

Fig 2

WORD LINKING GAME

The present invention relates to a game. More particularly, although not exclusively, the present invention relates to a game whereby words are constructed in response to questions.

In one aspect this invention provides apparatus for playing a game comprising:

a plurality of consonant cards each having a letter corresponding to a consonant printed thereon;

a plurality of vowel cards each having a letter corresponding to a vowel printed thereon;

a plurality of question cards each having a letter and a question printed thereon; and a timing means.

In an alternative embodiment, the question cards may have a score printed thereon.

Preferably the question relates to a word which contains the letter printed on the question card.

If a score is printed on the question card, it corresponds to the score a player receives if the player is able to answer the question.

Preferably the apparatus for playing the game further comprises score recording means such as paper and pencils.

Preferably the apparatus for playing the game further comprises letter shields adapted to prevent competing players viewing each others letters.

Preferably a number of the consonant and/or vowel cards are marked as blocked letters.

Preferably the blocked letters are identified by a line running diagonally across the card.

In an alternative embodiment, the apparatus may further include bonus letter cards which may be marked by a star or similar device, said bonus letter cards indicating that double points are to be awarded when a player has a bonus card.

Preferably each set of consonant and vowel cards are coloured and/or blank on one side.

The present invention further provides for a method of playing a game comprising the steps of:

shuffling consonant cards and laying them randomly face down on a playing surface;

shuffling vowel cards and laying them randomly face down on a separate part of the playing surface;

shuffling question cards and arranging the question cards face down in a deck from the top of which a new card may be drawn;

each player randomly chooses a set number of letter cards, for example 9 letter cards consisting of six consonant and three vowel cards;

each player takes a question card from the top of the deck and the player who selects a card with the highest points allocation starts first;

where two drawn question cards are of the same points value the selection is redrawn;

question cards used in determining the starting player are returned to the bottom of the deck alternatively, the players toss to determine who plays first;

the starting player picks a first question card;

the question is read out and the first player positions the question card on the playing surface so that it is visible to the other players;

the starting player is then given a preset time, such as 90 seconds, to correctly answer the question using the letter appearing on the question card and any of the player's 9 selected letters;

if the starting player cannot answer the question in the given time by forming a word corresponding to the answer to the question on the playing surface, the second player attempts to answer the same question using the second player's own letters and the letter appearing on the question card;

if any player answers the first or any other question successfully that player replenishes his/her cards by replacing the consonant and/or vowel cards used in the play by randomly selecting consonant and/or vowel cards in equal number to those used in answering the question;

players take turns picking question cards, taking advantage of whenever an opponent fails to answer, an building on the pattern of existing words on the playing surface, constrained by the limitation that block letters cannot be the originating point for new words unless there are two or less words on the table;

question cards unable to be answered by any player are returned to the bottom of the question card deck;

the winning player is one who accumulates a winning score, such as 75 points or more or scores more points than the opposition at the time that all consonants and vowel cards are exhausted.

In an alternative aspect, each player's score equals the number of letters required to correctly spell the word corresponding to the answer to the question.

In an alternative aspect each players score equals that shown on the question card which is part of the word corresponding to the answer to the question.

Teams may be substituted for individual players.

Preferably the method of playing the game is further constrained whereby no word corresponding to a plural can be constructed merely by the addition of an S card to an already existing word.

If a bonus letter card, which may be identified by being marked with a star, is used, the players points are doubled.

Preferably the method for playing the game is further constrained whereby an abbreviation is not considered a valid word.

The game will now be described by way of example only and with reference to the accompanying figures in which:

FIG. 1 shows a typical selection of cards for a player's starting position;

FIG. 2 illustrates a typical question card including a score;

Figure 3:
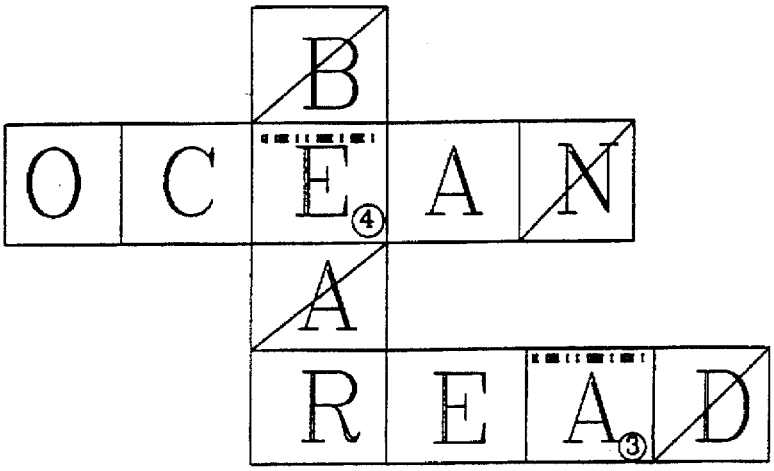
Figure 4:
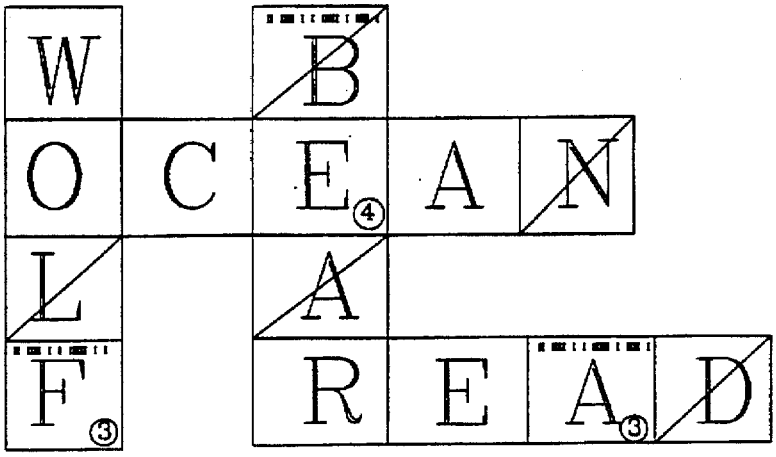

FIG. 3 indicates a typical word building situation set out on a playing surface; and FIG. 4 illustrates a correct answer word corresponding to the question card shown in FIG. 2.

The present game builds up words from individual letter cards. The game may be played on any flat surface or similar playing area and therefore does not require a board to play on or any other device for laying out or holding the cards.

In the particular example described below the numbers of consonant & vowel cards are as follows:

| | | | |
|---|---|---|---|
| B-6 | C-8 | D-8 | F-6 |
| G-8 | H-10 | J-4 | K-4 |
| L-10 | M-10 | N-10 | P-8 |
| Q-4 | R-10 | S-10 | T-10 |
| V-4 | W-8 | X-4 | Y-6 |
| Z-2 | | | |
| A-14 | E-14 | I-14 | O-14 |
| U-12 | | | |

The numbers of letter is not to be construed as restrictive and other numbers may be suitable for a range of proposed players or team numbers.

The object of the game is for a player to assemble or spell out words by building on an existing palm of words set out on a playing area. The player does this by 'answering' questions which appear on randomly selected question cards. Answering a question card corresponds to constructing a word using at least one of the players letter cards, at least one of the letters in the existing word pattern and the letter appearing on the question card and where the created word is an the 'answer' to the question.

The player has a fixed amount of time in which to respond to a question. If a player correctly constructs a word corresponding to a correct answer, that player gains the points stated on the question card as shown in FIG. 2.

Alternatively, the game may use question cards which do not include a score. In this embodiment, the players score is determined by the number of cards used to form the answer, i.e. if the word WOLF is spelt out, four points are gained.

The cards used in the game comprise three different types: vowel cards, consonant cards and question cards.

To man the game, the vowel and consonant cards are separately shuffled and laid out randomly in separate groups, face down, on a playing surface. The question cards are shuffled and placed face down in a deck on the playing surface. Each player then randomly selects 6 consonant and 3 vowel cards and sets them out so that they cannot be seen by the other players.

Referring to FIG. 1 a typical sample of a player's selection of cards is shown.

To start the game each player selects a question card from the top of the deck. The player who draws the question card stating the highest number of points begins the game. Alternatively, the players or teams may toss to determine who proceeds first.

The starting player picks the first question card. An example of a such a question card is shown in FIG. 2. The selected question card is read out and the first player leaves it in view of the other players. The player's time starts and typically the player is given 90 seconds to correctly answer the question using any of his nine letters.

Referring to FIG. 2, to answer the question correctly, the player must assemble a word which must include the letter 'F', correspond to an animal or bird and have more than three letters.

In the example shown in FIG. 3 a typical table situation is shown. The player selects the question card shown in FIG. 2. In answering, the player must use both the question card itself and any of the players own cards (selected from those shown in FIG. 1). The player correctly responds to the question by spelling out the word 'WOLF' using the existing letter 'O' in the layout shown in FIG. 3, the question card letter 'F' and the players own cards 'W' and "L". In this turn, the player scores 5 points, that being the amount shown on the question card shown in FIG. 2. In an alternative embodiment of the present game, the score allocated corresponds to the number of cards used to answer the question, i.e.; 4 points.

After placing the "answer word" on the playing area, the player replenishes his or her consonant or vowel cards from the remaining consonant or vowel cards.

A number of the vowel and consonant cards are "blocked". The letter 'L' in the example given above corresponds to a blocked card. A blocked card is one which cannot be used to build further words. Examples of blocked letters are B, N, A and D in FIG. 3. A blocked letter can only be used to build new words when there are two or less words on the table.

A number of cards may be designated "bonus cards". These are marked with a star or similar device and when used increase the players score for that answer by a set factor. In a preferred embodiment, bonus cards double the players score.

If a player cannot answer the question in the allotted time the next player in sequence attempts to answer the same question immediately or within a specified time limit.

Consecutive players take turns picking up question cards and taking advantage whenever the player preceding them fails to answer the question.

The winner is the player who accumulates at least 75 points or scores more points than the opposition at the time at which the consonant and vowel cards are exhausted.

A number of rule variations are possible as follows: adding a S to a word to form a plural does not constitute a valid word construction; answers should be in English only; and no abbreviations may be used. It is to be appreciated that other rules may be imposed on the present game structure depending on the target audience of the game and the degree of sophistication in the questions.

Where in the foregoing description reference has been made to elements or integers having known equivalents, then such equivalents are included as if they were individually set forth.

Although the invention has been described by way of example and reference to particular embodiments it is to be understood that modifications and/or improvements may be made without departing from the scope of the appended claims.

I claim:

1. A method of playing a game comprising the steps of:

shuffling consonant cards and laying them randomly face down on a playing surface;

shuffling vowel cards and laying them randomly face down on a separate part of the playing surface;

shuffling question cards and arranging the question cards face down in a deck from the top of which a new card may be drawn;

each player randomly chooses a set number of letter cards, for example 9 letter cards consisting of six consonant and three vowel cards;

each player takes a question card with a point from the top of the deck and the player who selects a card with the highest points allocation starts first;

where two drawn question cards are of the same point value the selection is redrawn;

the question cards used in determining the starting player are returned to the bottom of the deck, alternatively the players toss to determine which player proceeds first;

the starting player picks a first question card;

the question is read out and the first player positions the question card on the playing surface so that it is visible to the other players;

the starting player is then given a preset time, such as 90 seconds, to correctly answer the question using the letter appearing on the question card and any of the player's 9 selected letters;

if the starting player cannot answer the question in the given time by forming a word corresponding to the answer to the question on the playing surface, the second player immediately attempts to answer the same question using the second player's own letters and the letter appearing on the question card;

if any player answers the first or any other question successfully that player replenishes his/her cards by replacing the consonant and/or vowel cards used in the play by randomly selecting consonant and/or vowel cards in equal number to those used in answering the question;

players take turns picking question cards, taking advantage of whenever an opponent fails to answer, and building on a pattern of existing words on the playing surface, question cards unable to be answered by any player are returned to the bottom of the question card deck;

the winning player is one who accumulates a winning score, such as 75 points or more or scores more points than the opposition at the time that all consonants and vowel cards are exhausted.

2. A method of playing a game as claimed in claim 1 wherein each players score equals the number of letters required to correctly spell the word corresponding to the answer to the question.

3. A method of playing a game as claimed in claim 1 wherein each players score equals that shown on the question card which is part of the word corresponding to the answer to the question.

4. A method of playing a game as claimed in claim 1 wherein the first player is decided by tossing a coin or the like.

5. A method of playing a game as claimed in claim 1 wherein teams may be substituted for individual players.

6. A method of playing a game as chimed in claim 1 wherein said method is constrained whereby no word corresponding to a plural can be constructed merely by the addition of an S card to an already existing word.

7. A method of playing a game as claimed in claim 1 wherein the method is further constrained whereby an abbreviation is not considered as a valid word.

8. A method of playing a game as claimed in claim 1 wherein the question cards include bonus cards which increase a player's score by a set factor.

* * * * *